United States Patent [19]

Davison

[11] 4,037,827

[45] July 26, 1977

[54] FOOD PRODUCT MIXER WITH AN IMPROVED DOOR MECHANISM

[75] Inventor: Alan L. Davison, La Mirada, Calif.

[73] Assignee: F.P.E.C. Corporation, Maywood, Calif.

[21] Appl. No.: 640,729

[22] Filed: Dec. 15, 1975

[51] Int. Cl.[2] ..... B01F 5/00; B01F 7/00; B01F 15/02; B65D 5/72

[52] U.S. Cl. ..... 259/37; 222/495; 220/210; 220/346; 259/41

[58] Field of Search ..... 259/6, 9–10, 259/28, 36–37, 41, 45, 46, 115, 119–121; 220/210, 222, 345, 346; 222/495–497; 212/4

[56] References Cited

U.S. PATENT DOCUMENTS

| | | | |
|---|---|---|---|
| 1,092,691 | 4/1914 | Bryson | 222/497 |
| 3,134,576 | 5/1964 | Lodige | 250/41 |
| 3,198,491 | 8/1965 | Loomans | 259/41 |
| 3,995,542 | 12/1976 | Miecke | 99/574 |

*Primary Examiner*—Harvey C. Hornsby
*Assistant Examiner*—Robert Pous
*Attorney, Agent, or Firm*—Lindenberg, Freilich

[57] ABSTRACT

A food product mixer with a pair of door openings in its front panel includes a door mechanism with a pair of slideable doors. Each door is slideable on a pair of sliding rods toward and away from the opening with which it is associated. Means are provided to cause both doors to slide simultaneously on their sliding rods to a closed position in which each door closes its associated opening. The sliding rods on which each door slides are rotatable to separately lock the door when it is in its closed position, as well as to separately unlock it. An unlocked door slides back along its rods, away from the opening, due to food pressure applied theron by food in the mixer, thereby enabling the food to be discharged through the opening. Either door may be unlocked with the other door remaining in the locked position. The rotation of the rods to lock and unlock a door may be achieved manually or by actuated means. The entire door mechanism is covered by a protective enclosure so as to prevent food product, discharged through either or both openings, from being contaminated by matter from structural members located above the openings.

13 Claims, 7 Drawing Figures

FOOD PRODUCT MIXER WITH AN IMPROVED DOOR MECHANISM

BACKGROUND OF THE INVENTION

1. Field of the Invention

The present invention generally relates to food processing equipment and, more particularly, to a food product mixer with an improved door mechanism.

2. Description of the Prior Art

In food processing operations, food products, e.g., meat, in connection with which the invention will be described, is often mixed in a specially designed mixer, which is also referred to as a mixer-blender. Such a mixer must meet stringent design requirements and its use must be approved by appopriate government agencies. For example, the use of a meat mixer requires the approval of the meat inspection department (MID) of the Department of Agriculture. Typically, a meat mixer includes one or more rotatable shafts on which paddles, set in a spiral pattern are supported, or a similar arrangement, to mix the meat in the mixer enclosure. When the mixing operation is completed the meat is discharged through one or more door openings. These openings are generally closed by doors which are operable to move between closed and open positions.

One of the major disadvantages of prior art mixers is the fact that the doors are hinged to the panel, typically the front panel of the mixer housing, in which the door openings are formed. Consequently, it is quite difficult to clean the doors as thoroughly as required to meet government regulations. Also, the doors are opened and closed by hydraulic or electromechanical devices located above the doors. These devices swing the doors upwardly to open them, or downwardly to close them. Typically, bearing blocks, which support the mixing shafts are located external to the mixing enclosure, on the front panel above the doors. Due to the locations of the dooroperating devices it is practically impossible to place a separating panel between the bearing blocks and the door openings. Consequently, the bearing blocks are exposed to the zone into which the meat is discharged through the door openings, increasing the possibility of meat contamination, which is most undesirable. Furthermore, due to the force with which the doors are closed accidents to operators often occur. Operators' fingers are often clamped by the doors which are closed with a sufficiently high force to withstand the pressure, which is built up in the mixer enclosure during the mixing operations.

OBJECTS AND SUMMARY OF THE INVENTION

It is a primary object of the present invention to provide a new food product mixer with an improved door mechanism.

Another object of the present invention is to provide a new food product mixer with a novel door mechanism in which the doors are not hinged to the mixer enclosure for ease of door cleaning.

A further object of the invention is to provide a food product mixer with a novel door mechanism in which the doors are not hinged to the mixer enclosure, to thereby facilitate complete door cleaning, and which is protectable by means of a protecting enclosure to prevent food contamination from externally mounted bearing blocks or the like, and to maximize operator safety from injury during door operation.

These and other objects of the invention are achieved by providing a food product mixer with doors which are slideable on sliding rods which extend perpendicularly from the mixer's front panel, in which the door openings are formed. Each door is slideable on a pair of parallel sliding rods. Means are provided to urge the doors to slide on their respective rods to their closed positions. Once the doors are in their closed positions, each is separately lockable to remain in the closed position and withstand the pressure, produced by the mixed food product. Each door is separately unlockable and, subject to the food product pressure which is applied thereto, slides away from the door opening, thereby enabling the food product to be discharged therethrough. The entire door mechanism is covered by a protecting enclosure, including a top horizontal plate, which separates the door openings from bearing blocks mounted over them, thereby preventing food product contamination from the bearing blocks. Also, the protecting enclosure includes side panels, designed to protect an operator from injury by the operating door mechanism.

The novel features of the invention are set forth with particularity in the appended claims. The invention will best be understood from the following description when read in conjunction with the accompanying drawings.

DESCRIPTION OF THE PREFERRED EMBODIMENTS

The present invention will be described in connection with a meat mixer, equipped with two side-by-side mixing mechanisms and one having two door openings and two doors on which pressure is exerted by meat during the meat mixing cycle and when the meat is discharged through the door openings after the mixing cycle. Such mixers are well known in the art and the present invention is directed to the door mechanism including the doors. Although the invention will be described in connection with a meat mixer it should be stressed that it is not intended to be limited thereto and is applicable for use with a mixer for mixing any food product.

Figure 1:
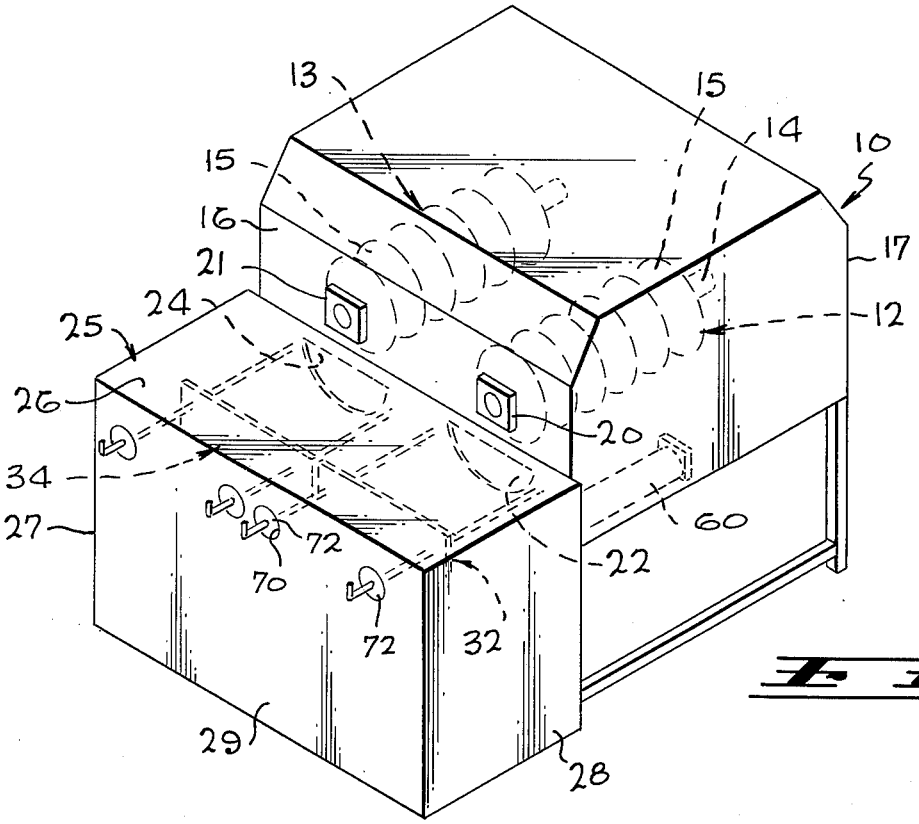
FIG. 1 is an isometric view of a food product mixer incorporating the present invention.

In FIG. 1, numeral 10 designates the mixer housing in which meat is mixed by a pair of side-by-side mixing mechanisms 12 and 13. Each consists of a central rotatable mixing shaft 14 on which paddles 15, set in a spiral pattern, are assumed to be supported. Each shaft 14 is supported by external bearing blocks. These bearing blocks are located on the mixer front panel 16 and the back panel 17. The external bearing blocks for shafts 14 of mixing mechanisms 12 and 13 on the front panel 16 are designated by numerals 20 and 21, respectively.

Located below the bearing blocks 20 and 21 in the front panel 16 are door openings 22 and 24, respectively. Each has a cross section which conforms to the shape of the mixer bottom which is generally semicircular. During a mixing cycle the door openings 22 and 24 are closed by doors. These doors are subjected to pressure by the meat being mixed during the mixing cycle. Thereafter, the mixing mechanisms are operated to push the mixed meat toward the openings and the meat is discharged through them when the doors are moved to their open position.

As previously pointed out and is appreciated by those familiar with the art, typically, the doors in a conventional mixer are hinged to its front panel. They are pivoted about a horizontal axis upwardly to open them or downwardly to close them, by door operating mechanisms which are located above the door openings. The manner in which the doors are opened and closed and the location of the doors' operating mechanisms make it impossible to isolate the bearing blocks 20 and 21 from the zone into which the meat is discharged through openings 22 and 24. That is, it is impossible to place a horizontal protective plate between the blocks 20 and 21 and the tops of the openings 22 and 24 so as to isolate the blocks from the zone in which the meat is discharged. This is most undesirable since any leakage from the bearing blocks may contaminate the discharged meat. Also, the fact that the doors are hinged to the front panel 16 makes their thorough cleaning quite difficult, which is also a great disadvantage.

The present invention is directed to a novel door mechanism for the meat mixer which eliminates the prior art disadvantages. Briefly, in the door mechanism of the present invention the doors, rather than being hinged to the front panel 16, are slideable on sliding rods which extend perpendicular to the front panel 16. They are slideable toward the front panel and lockable to be maintained in the closed position. By unlocking them the doors are able to slide away from the front panel along the sliding rods, thereby opening the door openings to enable meat to be discharged therethrough. As will be pointed out hereinafter each door is separately lockable and unlockable, so that one door can be unlocked and moved to its open position so that meat can be discharged through its opening, while the other door remains locked.

The door mechanism including the doors are enclosed by a protective enclosure 25 (see FIG. 1), which includes a top horizontal plate 26. It effectively isolates the bearing blocks 20 and 21 from the door openings 22 and 24, thereby protecting the meat discharged through these openings from contamination from the bearing blocks. Also, the protective enclosure 25 includes side panels 27 and 28 and preferably a front wall 29, so as to enclose the door mechanism to protect an operator from contact therewith, and thereby prevent possible injury to the operator, particularly when the doors are being urged to their closed position.

As will be pointed out hereinafter and as shown in FIG. 1 in one embodiment the front wall 29 of enclosure 25 is used to support the sliding rods near their outer ends, remote from their ends near the front panel 16 of the mixer 10. Only portions of the sliding rods, needed to lock the doors extend beyond wall 29.

Figures 2, 5:
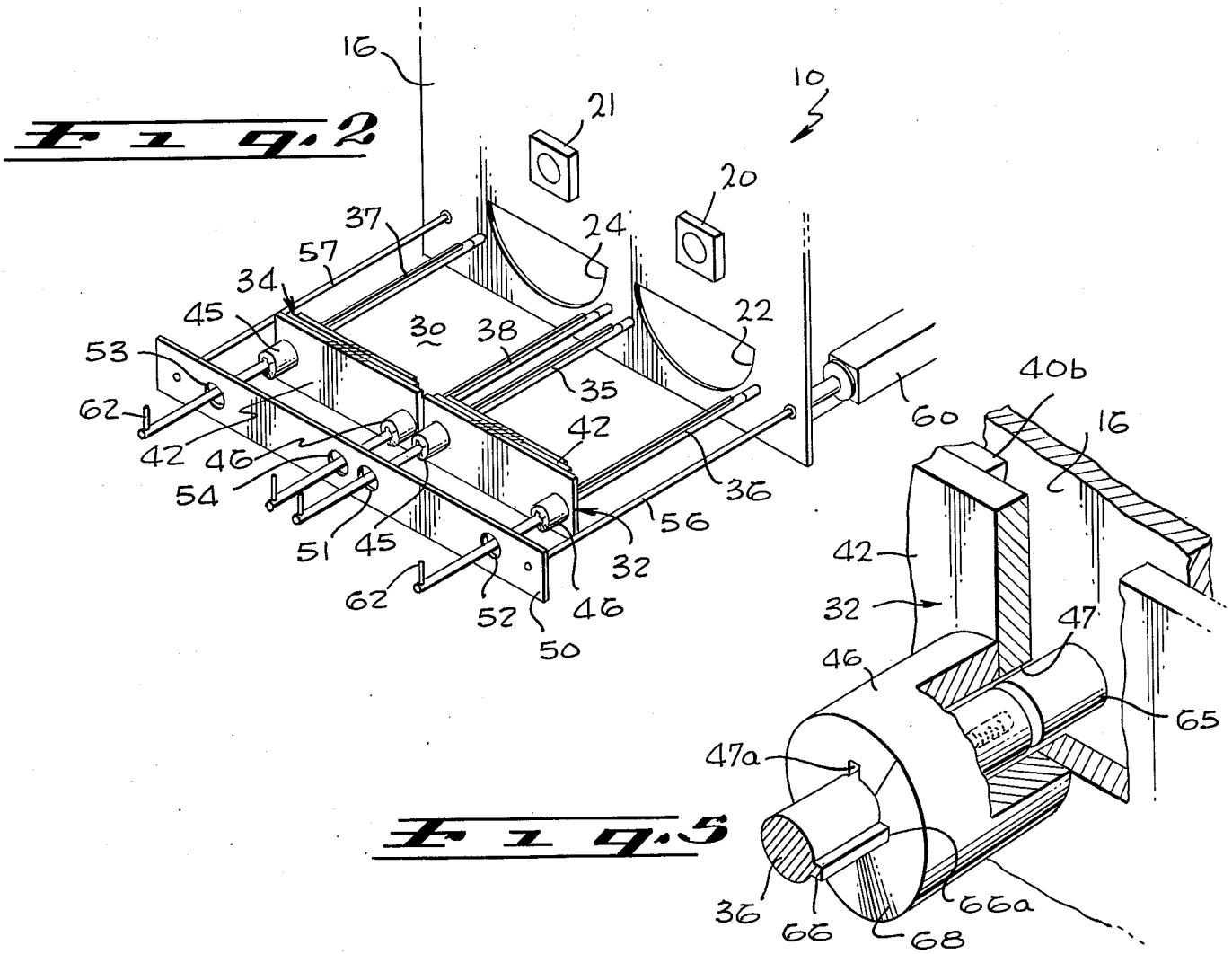
FIG. 2 is an isometric view of a door mechanism in accordance with the present invention.
FIG. 5 is an isometric fragmentary view useful in explaining the locking of a door in accordance with the present invention.

Attention is now directed to FIG. 2 which is an isometric view of one embodiment of the door mechanism of the present invention, with the protective enclosure 25 removed. The door mechanism 30 includes a pair of doors 32 and 34, associated with openings 22 and 24, respectively. The door 32 is slidable on a pair of parallel sliding rods 35 and 36, which extend perpendicularly from the panel 16. Similarly, door 34 is slideable on a pair of parallel sliding rods 37 and 38 which extend perpendicularly from the front panel 16.

Figure 3A:
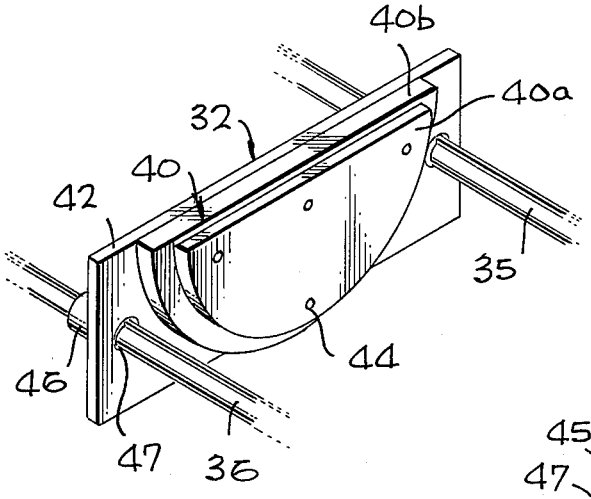
FIGS. 3*a* and 3*b* are isometric and expanded views of a door in accordance with the present invention.
Figure 3B:
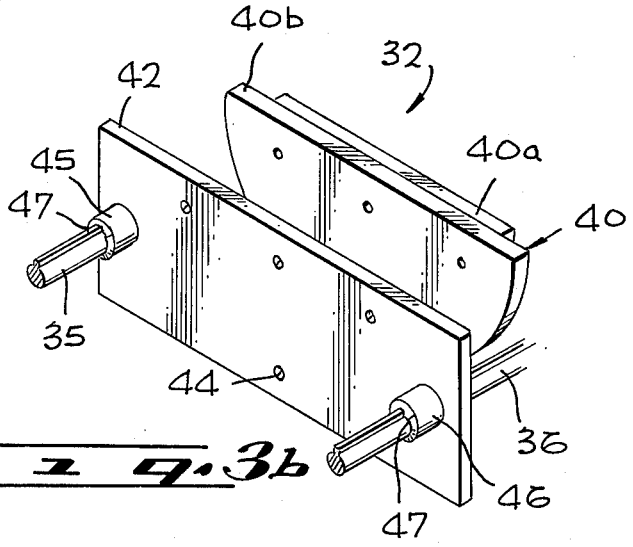

Assuming that the two openings 22 and 24 are identical the two doors 32 and 34 are identical. An isometric view of door 32 is shown in FIG. 3*a* and an isometric expanded view in FIG. 3*b*. Basically, the door 32 includes a plastic door seal 40 having a front portion 40*a*, shaped to conform to opening 22 and a back portion 40*b* of enlarged dimensions. The door 32 also includes a metal back plate 42 having a front side to which the back side of seal portion 40*b* is attached such as by screws 44. A pair of collars 45 and 46 extend from the back side of plate 42. Openings 47 extend through the plate 42 and the collars with the rods 35 and 36 extending through these openings so that the entire door 32 is slideable on the rods 35 and 36. Preferably, bushings are inserted into the openings 47 with the rods extending therethrough so as to minimize friction between the metal rods and the metal plate 42. However, to simplify the following description such bushings will not be shown. Door 34 is identical with door 32 and its parts are designated by like numerals, in the various figures.

It should thus be apparent that in the door mechanism 30 of the present invention door 32 is slideable on the rods 35 and 36 while door 34 is similarly slideable on the rods 37 and 38. The door mechanism also includes a door push plate 50 (FIG. 2) which is located behind the doors. It includes four openings 51–54 through which the sliding rods 35–38 respectively extend. The diameters of these openings are assumed to be slightly larger than the outer diameters of the collars 45 and 46 of the doors 32 and 34 for reasons which will become apparent from the following description.

Figure 4:
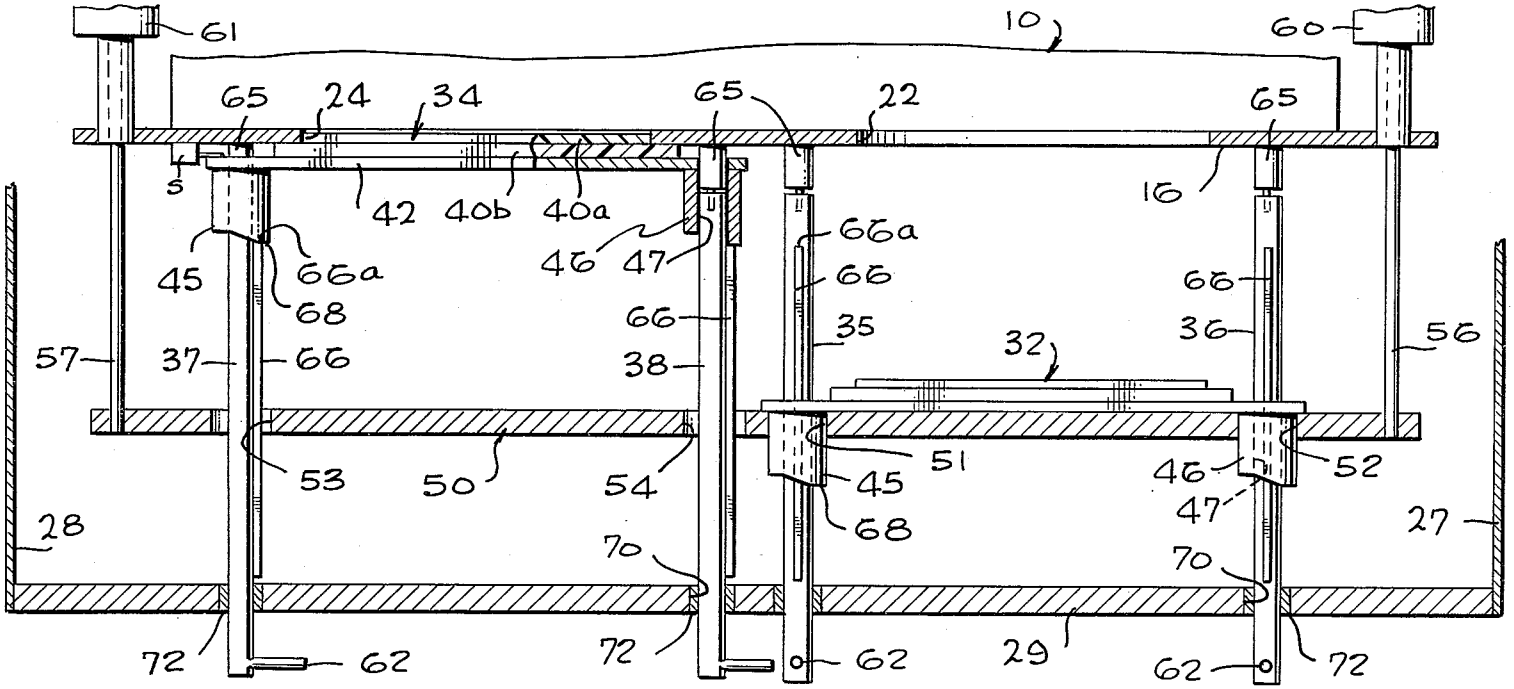
FIG. 4 is a top view of the door mechanism with one closed door and open door.

The door push plate 50 is supported by a pair of rods 56 and 57. These rods are attached at their outer ends to opposite ends of the plate 50, such as by welding or by being screwed into collars (not shown) extending from the plate. The other ends of rods 56 and 57 are connected to actuatable devices, such as air pistons, which when actuated pull the rods toward them, thereby pulling the plate 50 with them. In FIG. 2 only an air piston to which rod 56 is connected is shown and is designated by numeral 60. A similar air piston 61 is connected to rod 57, as shown in FIG. 4. The four sliding rods 35–38 lie in a common plane which is perpendicular to front panel 16. Similarly, the rods 56 and 57, which extend perpendicular to panel 16 also lie in a common plane perpendicular to panel 16. For explanatory purposes it is assumed that all six rods 35–38, 56 and 57 lie in the same plane.

On the other hand, the doors 32 and 34 and the door push plate 50 are disposed parallel to front panel 16. In FIG. 2, the doors 32 and 34 are shown in the open position, remote from the door openings 22 and 24. To move the doors to their closed position, the air pistons 60 and 61 to which rods 56 and 57 are attached are activated. Consequently, the rods 56 and 57 are pulled toward the air pistons, thereby pulling the plate 50 toward the front panel 16. As the plate 50 is pulled forward to panel 16, it engages the back plates 42 of the doors 32 and 34. And as the air pistons continue to pull plate 50 toward the front panel 16, plate 50 pushes the two doors ahead of it. This operation continues until each door reaches its closed position in which the door effectively closes its respective door opening. This may be sensed by a microswitch associated with each door. One microswitch, associated with door 34, is shown in FIG. 4 and is designated by S. It is assumed to be activated by plate 42 of the door 34 when the latter reaches its closed position. In the closed position the front portion 40*a* of the seal 40 of each door effectively fills the door opening while the enlarged portion 40*b* of the seal 40 is pressed against the front panel 16 by the door back plate 42 and acts as a seal around the opening periphery.

Once the doors are in their closed position each is separately lockable, to remain in the closed position, so as to be able to withstand pressure exerted thereon by meat, mixed in the mixer 10 during the mixing cycle. In one embodiment of the invention the sliding rods, associated with each door, are also rotatable when the door is effectively at the closed position. As shown in the figures, a separate handle 62 extends from each of the four rods 35–38 near its outer end. When door 32 is effectively at the closed position, as indicated by the activated microswitch, an operator, by means of handles 62, rotates rods 35 and 36 to provide a camming or locking action between the rods and the back plate of door 32. This locking action prevents the door from being pushed away from the front panel 16 in spite of any pressure exerted on the seal thereof by mixed meat in the mixer.

Although a specific door locking arrangement will be described hereinafter it should be apparent that any locking means may be used to lock the door in the closed position by means of the rods or by any other means, once the door is effectively at its closed position. Door 34 is similarly lockable by rotating rods 37 and 38 by means of handles 62 which extend therefrom. Once the two doors are locked the air pistons 60 and 61, which pulled the plate 50 which in turn pushed the doors toward panel 16 to their closed position, are deactivated. Consequently, plate 50 is free to be pushed in a direction away from panel 16. As will be pointed out this occurs only after at least one of the doors is unlocked and is pushed away from panel 16 by the pressure exerted thereon by the mixed meat in the mixer.

During the mixing cycle even though the air pistons 60 and 61 are deactivated since each door is separately locked it can withstand the pressure in the mixer produced by the mixing action, and therefore does not open due to said pressure. After the mixing cycle or at any point in which it is desired to discharge meat from the mixer either or both doors can be opened by rotating the rods associated therewith to the unlocked position. For example door 32 can be unlocked by rotating rods 35 and 36 by means of handles 62 to their unlocked position. Once rotated to this position the door 32 is free to slide back on the rods 35 and 36 away from panel 16 and thereby move to its open position.

In the present invention once the door 32 is unlocked it is assumed to be opened by the pressure which the mixed meat in the mixer 10 exerts on the door seal 40. Once the door 32 is opened, meat is discharged through opening 22. The extent to which the door is opened, i.e., the distance it is pushed away from panel 16 depends on the pressure exerted thereon by the discharged meat. As door 32 is pushed back from panel 16 it pushes the plate 50 ahead of it. The force needed to push plate 50 is minimal since the air pistons are deactivated.

It should be stressed that in the novel door mechanism 30 of the present invention while the plate 50, when the air pistons are activated, pushes both doors toward their closed position, each door is separately lockable in the closed position. Consequently, at any point during the mixing cycle or thereafter either door alone can be unlocked and pushed to the open position by the meat pressure, while the other door remains in the locked position, and therefore is prevented from being pushed to its open position. It should further be pointed out that in the embodiment, described so far, the two rods on which each door slides serve a double function. They act as sliding rods on which the door slides toward the closed position when pushed by plate 50, and on which the door slides away from front panel 16 when it is moved to the open position by the meat pressure. In addition, however, these rods are rotatable between locking and unlocking positions to provide part of the mechanism for locking the door in the closed position.

By locking the door on opposite sides by means of the two rods the door is held tightly against the front panel 16 and is able to withstand the pressure in the mixer created during the mixing cycle. The locked doors do not pulsate or oscillate, which is the case in the prior art, in which hinged doors are incorporated. In the prior art due to the pressure in the mixer even when the doors are closed by their closing mechanisms they often tend to oscillate. This is very undesirable since some meat tends to be discharged through the door opening during the door oscillation.

In FIG. 4 the door mechanism 30 is shown in cross sectional view about a horizontal plane. In FIG. 4, door 34 is shown in the locked position and door 32 in the open position. FIG. 5 is a perspective fragmentary view of door 34 in the locked position. FIG. 5 is particularly useful in highlighting one arrangement of locking the door by means of the sliding rods. As seen from FIG. 4, extending outwardly from front panel 16 are four locking bar studs 65 to which the front ends of the sliding rods 35–38 are threaded. The sliding rods are assumed to have a substantially circular cross section (see FIG. 5) except that each has an elongated key 66 extending therealong, up to a cam abutting end 66*a* near the front end of the rod. The openings 47 in the door plate 42 and its collars 45 and 46 are also circular and further include keyways 47*a*, as shown in FIG. 5.

In the unlocked position the rods are rotated so that their keys 66 are aligned with the keyways 47*a* of openings 47 of the door back plate 42 and the collars 45 and 46. Consequently, the doors are free to slide over the rods. The keys 66 extend up to their cam abutting ends 66*a* so that when a door is in the closed position the rods are rotatable so that the cam abutting ends 66*a* abut against the back walls of the collars 45 and 46 thereby preventing the doors from sliding back on the rods away from the front panel 16. Preferably, each collar has a tapered guide or camming surface 68 extending from its back wall. When the rods are turned a portion of a rotation the camming action between the key ends 66*a* and the camming surface 68 further pushes the door toward the front panel 16 thereby securely locking it thereto. In the locked position the seal portion 40*a* of each door effectively fills the door opening and the seal portion 40*b* is pressed around the door opening between the front panel 16 and the door's back plate 42.

Door unlocking is achieved by rotating the doorsupporting rods, such as rods 35 and 36 of door 32, to align the rods' keys 66 with the keyways 47*a* of openings 47 in the collars 45 and 46. Once so aligned the door is unlocked and is able to slide back on its associated rods.

Any meat pressure on seal 40 pushes the door away from the door opening, thereby opening the door. As the door 32 is pushed away from the front panel 16 its collars 45 and 46 pass through the openings 51 and 52 in the push plate 50 (see FIG. 4). When the door plate 42 engages the push plate 50, as the door continues to be pushed away from the front panel 16, it pushes the push plate 50 ahead of it.

In order to provide a relatively large door stroke opening, e.g., 10", the rods have to be quite long, i.e., longer than 10". Although the rods are supported at their front ends by the studs 65 it is desirable to support them near their outer ends, where the locking handles 62 are located. This is achievable by providing four openings 70 (see FIG. 4) in the front wall 29 of the enclosure 25, with an appropriate bushing 72 in each opening 70, through which the outer ends of rods 35–38 with their locking handles 62 extend. In this embodiment, in which door locking is assumed to be accomplished by an operator rotating the rods by means of the handles 62, the handles and only the rods outer ends to which the handles are attached are exposed outside of the protective enclosure 25, as seen from FIGS. 1 and 4.

Figure 6:
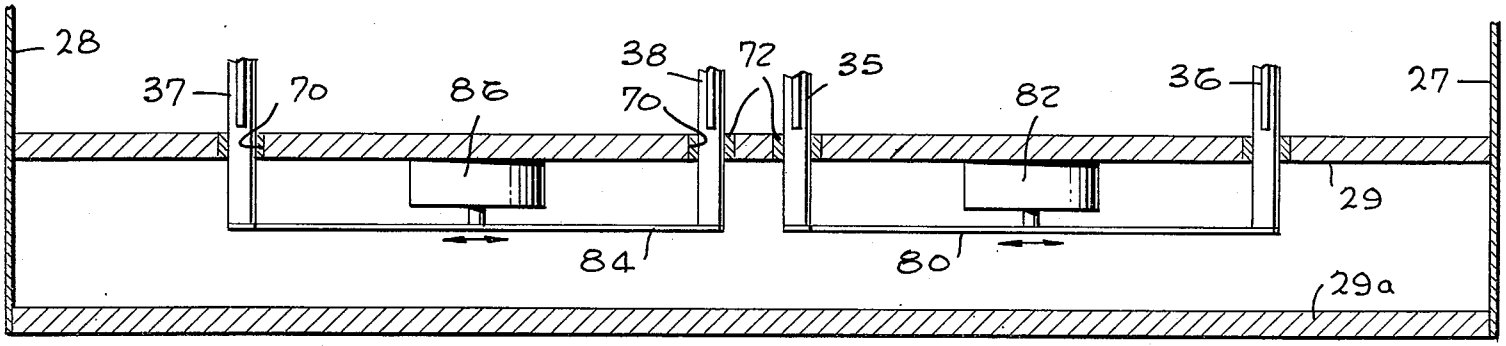
FIG. 6 is a partial top view of another embodiment of the door mechanism in accordance with the present invention.

It should be apparent that if desired the rods may be rotated to lock the doors by other than an operator rotating the rods by turning the handles 62. Pneumatic, hydraulic or electromechanical devices may be used to rotate the two rods, associated with each door, to their locked position and thereby lock the door, as well as, rotate the rods to their unlocked position to enable the door to be pushed to its open position by the discharging meat pressure. A simplified arrangement to accomplish this end is shown in FIG. 6. Therein, the ends of the rods 35 and 36 which extend beyond front wall 29 are shown coupled by a cross bar 80 which is in turn connectable to a shaft of a motor 82. The motor can be used to simultaneously rotate the two rods, such as by a rack and pinion assembly, to the locking position, and when required rotate them back to the unlocked position. A similar cross bar 84 is shown linking rods 37 and 38 which are rotatable between the locking and unlocking positions by a motor 86.

In addition to the front enclosure wall 29 on which the motors 82 and 86 may be mounted a second outer enclosure front wall **29*a* (see FIG. 6) may be used to completely enclose the door mechanism, including the rods-rotating motors 84 and 86** and thereby protect an operator from any accidental contact therewith. The locking and unlocking of each door by rotating the rods on which the door is supported by other than manually rotating the rods may be preferred, particularly where the entire operation of the mixer is controlled from a master control panel.

From the foregoing it should thus be appreciated that in the novel door mechanism 30 of the present invention each door is independently slideable on a pair of sliding rods. A door pushing mechanism, shown as push plate 50, rods 56 and 57 and air pistons 60 and 61 is used to push the doors when they are open to their closed position. This is achieved by causing the doors to freely slide on their respective rods toward the mixer front panel 17 until they are at their closed position, which may be sensed by microswitches, such as switch S, or other like devices. Once the doors are slid on the rods to their closed position, each is separately lockable to remain in the closed position in spite of any pressure exerted thereon from within the mixer.

Door locking is accomplished by rotating either and preferably both rods on which the door slides to a locking position when the door is in the closed position. The rotation of the rods produces a clamping force against the door's metal plate, thereby locking the door and preventing it from sliding back away from the mixer front panel along the rods. Once the doors are separately locked the door pushing mechanism is deactivated. In particular description the deactivation is achieved by deactivating the air pistons 60 and 61. By producing the clamping force against the door's metal plate at its two collars 45 and 46 which are practically at opposite ends of the door, door pulsation is practically eliminated.

When desired either door can be separately unlocked. Unlocking is achieved by rotating the door's sliding rods to their original, unlocking position in which the door is free to slide on the rods. In the embodiment described hereinbefore this is achieved by aligning rod keys 66 with the door keyways **47*a*. When a door is unlocked it is moved from its closed position to the open position by pressure of meat in the mixer. Due to this pressure the door is pushed away from the front panel 16** enabling mixed meat to be discharged through the door opening. The door being pushed, slides back on its sliding rods on which it is mounted. The extent of door opening, namely the distance that the door is pushed back from the front panel, depends on the meat pressure.

As the door slides back it pushes the door pushing plate 50 ahead of it. It should be stressed that neither door is physically attached to the pushing plate 50, or to the sliding rods on which the door is free to slide in either direction, except when locked in the closed position. It should also be pointed out that in the present invention while both doors are pushed simultaneously to their closed position by plate 50, the pushing force required is very small since the doors slide freely on their respective rods. Thus, potential injury to an operator during door closure is greatly reduced. Both doors should be locked before initiating the mixing cycle. However, as clearly pointed out hereinbefore, when desired only one of the doors may be unlocked and thereafter opened by the meat pressure, while the other door can remain locked. It should be stressed that once a door is unlocked, by rotating its sliding rods to their unlocking position, the actual opening of the door from the closing position to the open position is achieved by the meat pressure which is exerted on the door, pushing it away from the front panel 16.

Since the doors operate (i.e. slide) on a horizontal axis, perpendicular to the mixer front panel 16, below the bearing blocks 20 and 21 the protective enclosure 25 can and in practice does include the horizontal top plate 26 which covers the top side of the entire door mechanism, thus preventing possible injury to an operator. However, in addition it isolates the bearing blocks 20 and 21 from the zone into which meat is discharged through the openings 22 and 24, thereby preventing any contamination of the meat from any matter leaking out of these blocks. The ability to incorporate the horizontal protective top plate 26 above the openings 22 and 24 and thereby isolate the meat discharged through these openings from contaminants from structural elements located above the openings is very important since it practically eliminates meat contamination. Such a horizontal protective plate cannot be incorporated in prior art mixers in which the doors are operated by mechanisms located above the openings.

Another very significant feature of the present invention is the free sliding doors. The doors are not hinged to the front panel 16, but rather freely slide toward and away from it on their sliding rods. Consequently, the doors can be removed and thoroughly cleaned, which is not attainable in the prior art with the hinged doors. Also, these portions of the sliding rods which may be exposed to discharged meat can be cleaned very thoroughly, thereby minimizing any potential meat contamination.

It should be apparent that although the invention was described in conjunction with a two-door mechanism the invention is not intended to be limited thereto. It can incorporate more than two doors, each with its separate pair of sliding and locking rods such as rods 35 and 36 of door 32. Also, if desired it can incorporate a single door, when used with a mixer having a single door opening.

In a single door embodiment, if desired, the push plate 50 may be physically attached to the back plate 42 of the single door. Also, instead of locking the door by means of the rotatable sliding rods, on which the door slides, the locking action, once the door is in the closed position, may be achieved by maintaining a high pulling force on the plate 50 by means of the pistons 60 and 61 thereby pressing the door against the front plate 16, as long as the door has to remain closed. Door opening may be realized by releasing the pulling force on plate 50 so that any meat pressure on the door would cause it to slide back on the sliding rods away from the front panel 16.

In the embodiment described so far once a door is unlocked it is assumed to be opened by the meat pressure exerted on the door from within the mixer. In such an arrangement the extent of door opening depends on the meat pressure. Clearly, if desired a door, after being unlocked, may be opened by being pulled away from the front panel 16, such as by means of a rod attached to the door's back plate 42. Such a rod may be manually or mechanically pulled so as to cause the door to slide on the sliding rods away from the front panel 16, independently of the meat pressure.

Although particular embodiments of the invention have been described and illustrated herein, it is recognized that modifications and variations may readily occur to those skilled in the art without departing from the spirit of the invention. For example, door locking once a door is slid to its closed position may be achieved by other than rotating the rods to produce the camming force against the door's collars 45 and 46 so as to lock the door. However, it is believed that door locking by means of rotating the rods is a preferred arrangement since a double use is made of the rods. That is, they are used to enable the door to slide thereon as well as for locking it in the closed position.

It should be stressed that the figures are used to facilitate the description of the invention rather than to limit it thereto. For example in FIG. 5 the rod 36 is shown extending into collar 46 when the door is in the closed position. If desired the length of the stud 65 may be extended so that when the door is in the closed position the front end of the stud 65 is practically flush with the front face of collar 46. Preferably, the stud 65 should have a key-like key 66 of the rod 36. In such a case the key end **66*a* should extend to the end of rod 36. It should be pointed out that in either case the front end of the rod is threaded to a threaded portion which extends from the stud's front end. In the unlocked position there is a sufficient clearance between the front ends of the stud 65 and the rod 36, to enable the rod to be rotated to its locked position. As a result of such rotation the rod moves closer to the stud, thereby pushing the door tightly against the front panel 16. In the unlocked position the keys 66 of the rod 36 and its supporting stud 65** are aligned with one another.

Since the modifications and equivalents may occur to those skilled in the art without departing from the spirit of the invention, it is intended that the claims be interpreted to cover all such modifications and equivalents.

The embodiments of the invention in which an exclusive property or privilege is claimed are defined as follows:

1. For use with a food product mixer of the type defining a mixer enclosure with mixing means therein for mixing the food product in said enclosure, the enclosure having a substantially vertical front panel with $n$ door openings defined therein through which food product is dischargeable, $n$ being an integer, a door mechanism comprising:

a separate slideable door associated with each opening;

separate slide means associated with each door and extending in a direction perpendicular to said front panel for supporting the door thereon, with said door being slideable on said slide means toward and away from said front panel;

actuatable door pushing means for urging each door to slide on said slide means toward said front panel until said door is in a closed position in which the door enclosed its associated opening; and separate operable locking means associated with each door for selectively locking each door when the latter is in the closed position and for unlocking said door, said door when unlocked being moveable from the closed position to an open position by sliding on said slide means away from said panel and the opening defined therein, wherein said slide means and said operable locking means comprise a pair of parallel, spaced apart rods, associated with each door, and disposed in a plane perpendicular to said front panel, with the door being slideable on said pair of rods toward said front panel when pushed by said door pushing means, with the pair of rods being rotatable to a locking position to physically clamp said door against said front panel when the door is in the closed position and thereby locks it to prevent it from sliding back on said rods away from said front panel, said rods being rotatable to an unlocked position in which said door is free to slide on said rods away from said front panel and the opening defined therein, thereby moving the door from its closed position to an open position.

2. The mechanism as described in claim 1 wherein the mixer includes bearing means which are exposed on said front panel above said openings, and said door mechanism is below said bearing means and includes an enclosure including a horizontal plate extending outwardly from said front panel and spaced between said bearing means and said openings.

3. The mechanism as described in claim 1 wherein $n=2$ defining first and second openings and said door mechanism includes first and second separate doors associated with said first and second openings, respectively, and said door pushing means comprise means for simultaneously urging both said doors to slide on their associated rods toward said front panel until each of said doors is in its closed position in which the door encloses its associated opening, with each door being separately lockable in its closed position by the rotation of its associated rods to their locking position, and being separately unlockable by the rotation of its associated rods to their unlocking position, whereby one of said doors is unlockable and is free to move away from said front panel and the opening with which it is associated by sliding on its associated rods while the other door remains locked in the closed position, and said rods including manually operable means at the rods' ends, remote from said front panel, for manually rotating said rods between their locking and unlocking positions.

4. The mechanism as described in claim 3 wherein each door after being unlocked slides on its associated rods away from its associated opening due to pressure applied thereto through the opening by food product in said mixer.

5. The mechanism as described in claim 3 wherein said door pushing means includes a push plate positioned behind said doors, remote from said front panel, and actuatable means coupled to said push plate for pulling said push plate toward said front panel with said push plate engaging back sides of said doors and urging the doors to slide toward said front panel as said push plate is pulled toward it.

6. The mechanism as described in claim 5 wherein said actuatable means of said door pushing means is deactivated when said doors are locked in their closed position, with either unlocked door, when moving away from said front panel by sliding on its associated rods, pushes said push plate away from said front panel.

7. The mechanism as described in claim 6 wherein the mixer includes bearing means which are exposed on said front panel above said openings, and said door mechanism is below said bearing means and includes an enclosure including a horizontal plate extending outwardly from said front panel and spaced between said bearing means and said openings.

8. The mechanism as described in claim 1 wherein $n=2$, defining first and second openings, and said door mechanism includes first and second separate doors associated with said first and second openings respectively, and said door pushing means comprise means for simultaneously urging both said doors to slide on their associated rods toward said front panel until each of said doors is in its closed position in which the door encloses its associated openings, with each door being separately lockable in its closed position by the rotation of its associated rods to their locking position, and being separately unlockable by the rotation of its associated rods to their unlocking position, whereby one of said doors is unlockable and is free to move away from said front panel and the opening with which it is associated by sliding on its associated rods while the other door remains locked in the closed position.

9. The mechanism as described in claim 8 wherein the mixer includes bearing means which are exposed on said front panel above said openings, and said door mechanism is below said bearing means and includes an enclosure including a horizontal plate extending outwardly from said front panel and spaced between said bearing means and said openings.

10. The mechanism as described in claim 9 wherein said door pushing means includes a push plate positioned behind said doors remote from said front panel and actuatable means coupled to said push plate for pulling said push plate toward said front panel with said push plate engaging back sides of said doors and urging the doors to slide toward said front panel on said push plate is pulled toward it and wherein said actuatable means of said door pushing means is deactivated when said doors are locked in their closed position, with either unlocked door when moving away from said front panel by sliding on its associated rods pushes said push plate away from said front panel.

11. The mechanism described in claim 9 wherein the pair of rods associated with each door include manually operable means for rotating said rods between their locking and unlocking positions.

12. The mechanism as described in claim 9 wherein each door after being unlocked slides on its associated rods away from its associated opening due to pressure applied thereto through the opening by food product in said mixer.

13. In a food product mixer of the type defining a mixer enclosure with mixing means therein for mixing food product in said enclosure, said enclosure defining at least one door opening through which food product is dischargeable, the improvement comprising:

a sideable door associated with said door opening;

slide means coupled to said enclosure for enabling said door to slide on said slide means toward and away from said opening, said slide means comprises a pair of spaced apart parallel rods and said door includes means for facilitating the sliding of the door on said pair of rods toward and away from said opening; and actuating means including means for urging said door to slide on said slide means toward said opening and enclose the latter, and operable locking means for selectively locking said door when it encloses said opening to prevent food product from exiting said enclosure through said opening, said door being unlockable by said operable locking means whereby said door is slideable on said slide means away from said opening by pressure appliable thereto by food product exiting said enclosure through said opening.

* * * * *